US005339655A

United States Patent [19]

Grando

[11] Patent Number: 5,339,655

[45] Date of Patent: Aug. 23, 1994

[54] GEM SETTING AND METHOD FOR ASSEMBLING THE SAME

[76] Inventor: Stefano Grando, 1131 Alta Loma Rd., #501, Los Angeles, Calif. 90069

[21] Appl. No.: 37,906

[22] Filed: Mar. 26, 1993

[51] Int. Cl.[5] ..... A44C 5/00; F16G 13/00

[52] U.S. Cl. ..... 63/9; 63/3; 63/26; 59/80

[58] Field of Search ..... 63/3, 9, 26, 28, 4; 59/80, 82

[56] References Cited

U.S. PATENT DOCUMENTS

| | | | |
|---|---|---|---|
| 1,092,587 | 1/1914 | Meyers | 482/147 |
| 1,467,468 | 9/1923 | Blanchard . | |
| 1,573,927 | 2/1926 | Fulford | 63/26 |
| 2,584,207 | 2/1952 | Holl | 59/80 |
| 2,870,598 | 1/1959 | Hess | 482/71 |
| 3,218,795 | 11/1965 | Kunzmann | 59/80 |
| 4,400,932 | 8/1983 | Epstein | 63/28 |
| 4,781,038 | 11/1988 | Branca et al. | 482/147 |
| 4,819,453 | 4/1989 | McNamara | 63/26 |
| 5,155,990 | 10/1992 | Pöll | 59/80 |

*Primary Examiner*—Peter M. Cuomo
*Assistant Examiner*—Michael Milano
*Attorney, Agent, or Firm*—Poms, Smith, Lande & Rose

[57] ABSTRACT

A gem setting comprised of a plurality of interconnected links. Each link has a male end at each end, an opening for receiving and holding a gem stone therein, and an apertured raised portion forming a platform for setting the base of the gem stone when assembled. A rimmed embossment presses over the top edge of the gem stone holding it securely in place. The embossment, along with a plurality of prongs, secures the gem stone in place. A female opening is provided in each link between the gem opening and the raised portion. In assembling, the male ends of one link are grasped together, the gem stone being disposed in the opening with the raised portion abutting against the base thereof, the base of the stone entering the aperture in the raised portion, and inserted into the female opening, then turned to lock one link to another forming the setting.

22 Claims, 2 Drawing Sheets

Fig. 4.
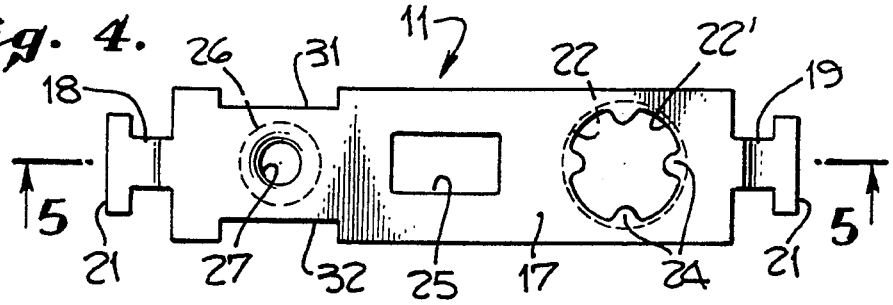
Fig. 5.
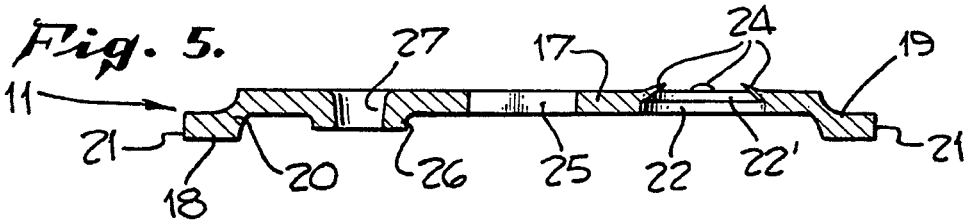
Fig. 6.
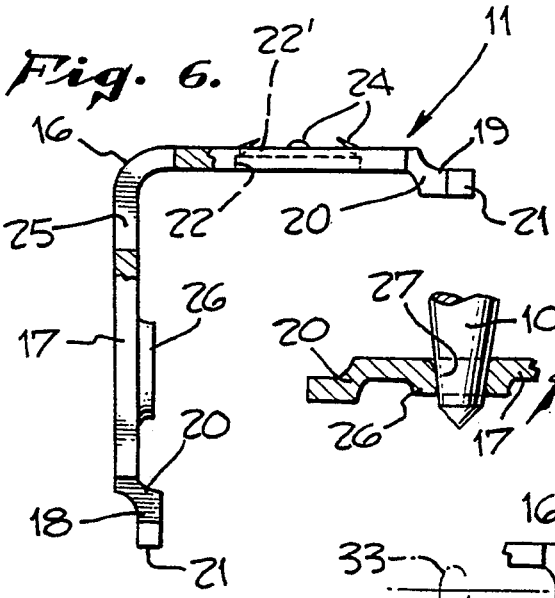
Fig. 7.
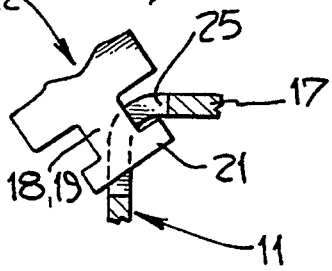
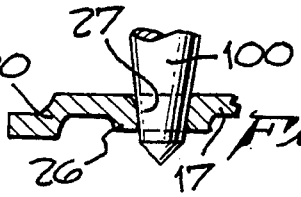
Fig. 10.
Fig. 8.
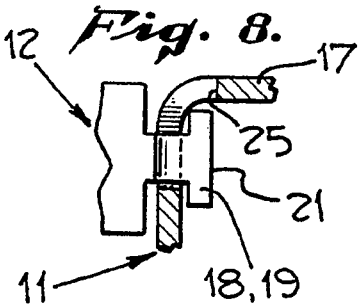
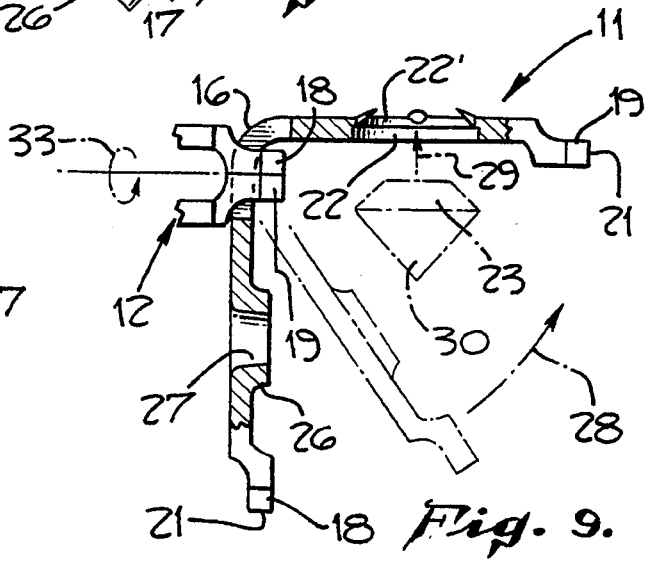
Fig. 9.

GEM SETTING AND METHOD FOR ASSEMBLING THE SAME

BACKGROUND OF THE INVENTION

1. Field of the Invention

The invention relates to gem settings; and, more particularly, to a gem setting comprised of a plurality of interconnected links and a method for assembling the same.

2. Description of the Prior Art

Various methods of assembling settings for retaining gem stones therein are known in the art.

Casting or Lost Wax Process

This is the most traditional method of setting stones. It is the main method of production which has all of the components in one unit necessary to set multiple stones for jewelry that is flexible. However, the labor intensity of producing jewelry by the use of this method is extremely timely and costly. The setting is often used to set valuable stones and offers only one measure of security as compared to applicant's method which secures the stone four ways. The following describes the method of production.

Method of Production

The lost wax process requires one skilled laborer to manually make a wax model of the setting design by hand. The mold is then placed into plaster of paris which is in a liquid form. The mold and plaster is then placed into an oven where they are baked, so that the plaster hardens and the wax liquifies. The plaster is removed from the oven and the liquid wax is drained when a hole is made into the plaster. The plaster now has an impression made of the wax model. The impression is filled with liquid karat gold or base metal. The metal is dispersed by either centrifugal force or a vacuum process. The hot liquid metal solidifies as it becomes cool. The next step is to break open the plaster and remove the setting. The setting is rough in form and must be lapped to remove the excess material that forms as a result of the lost wax process and then polished for shine and smoothness. A second skilled laborer takes the setting and solders a hinge to one side and drills a hole to the other side in order to produce a multiple setting. The hinge of one setting is attached to the hole of another setting and the process is repeated until one reaches the desired length. If a single setting is desired, then the setting must be soldered onto a base; e.g., ring base, earring cup, etc.

A third laborer actually sets the stones with great manual dexterity. The prongs of the setting have a slight ledge where the stone rests. Only the widest diameter of the stone rests on the ledge. The stone is held into place by the prongs which are bent at the tips to slightly cover the stones locking them into place. The prongs are manually pressed to hold the stone in place. A disadvantage is that the prongs are made of fine strips of metal which easily and often break or loosen due to the holding means weakening. When this happens, the stone falls out and may be lost.

Wire Forming

Another method used to set stones is wire forming. A piece of flattened wire is shaped into a desired form to frame a stone. The wire is beveled inside so that the stone can be held by the widest diameter which fits into the beveled edge. A gap can be made at each end of the setting to allow a connecting ring to join the setting to another setting of the same method or additional jewelry parts. This method offers the stone little security as the metal is flexible and soft. The stone can easily fall out. This method is usually used for inexpensive stones.

Snap Settings

This type of setting uses a setting made from sheet metal that has been die cut. The die cut design is molded to resemble a setting that is cast. The setting, according to the manufacturer, is used solely for setting individual stones for rings and earrings. If one were to produce this setting for multiple stones, one would follow the same process as that of casting. The advantage of this setting is that one is able to produce a large quantity of the settings by die cutting the settings. The disadvantage is that one must solder the settings to a base and the setting itself only secures the widest diameter of the stone by its prongs. If one were to convert this setting to a multiple setting, it may be possible to solder a hinge and drill a hole and solder the hinge to the hole. Again, like casting, as in the method previously discussed, this is labor intensive, costly and requires three skilled laborers.

Channel Settings

In this method of forming settings, channels are soldered onto a base with the inner space between the two channels being the same diameter as the stone. There is a ledge below the top of the channel on the inside of the channel where the widest diameter of the stones rest. The channels are then manually squeezed together to hold the stones into place. Again, it is easy for the channels to loosen and the stones to fall out since this method offers only the security of the pressure of the channels against the widest diameter of the stones. Channel settings are made by the last wax process. The channels and the base are one unit. Like casting, they require a hinge to be soldered, a hole to be drilled and lapping for flexible multiple links. The settings must then be lapped. To set stones by the channel method, it is more laborious than casting. Fewer finished products are made per hour and per day than casting. Channel settings require more precious metal than settings made by casting, which makes them more expensive to produce.

In conclusion, in the past, some gems are set into conventional settings by inserting them into an opening and bending tops of prongs manually inwardly to cover the widest diameter of the stone and secure it in place. Some settings are preformed with such prongs. Of course, such preformed prongs must be carefully machined. Some gems are set into channel settings which are then carefully squeezed to hold the gem in place. Of course, this is done manually and one must be careful so as not to damage the gem. Wire forming secures only the widest diameter of the stone and is used primarily for inexpensive stones as the method offers a poor level of security.

There is a need for quickly and easily producing jewelry parts, such as clasps, chains, etc. wherein links retaining gem stones therein can be interconnected quickly and easily without need for soldering or connecting rings or both. There is also a need for setting stones more securely then those of prior methods.

SUMMARY OF THE INVENTION

It is an object of this invention to provide an improved gem setting comprised of a plurality of interconnected links.

It is another object of this invention to provide a method for quickly and easily assembling one link of a gem setting to another to interconnect the same.

These and other objects are accomplished by providing a gem setting comprised of a plurality of interconnected links. The links may be elongated, square, round, oval, or decorative in design and form, etc. Each link has a male end at each end, a hole for receiving and holding a gem stone therein, and an apertured elevated platform for holding the base of the gem stone when assembled. A female opening is provided in each link between the gem hole and the cavity. In assembling, the male ends of one link are grasped together, the gem stone being disposed in the hole with the cavity abutting against the base thereof, and inserted into the female opening, then turned to lock one link to another forming the setting.

It is also within the object of the invention to better secure a gem stone within a setting. The elevated platform forms a snug crown around the bottom of the stone. An embossed or rimmed opening around the stone at its periphery serves as a further retention of the stone should one or more prongs break. The rim or embossment overlaps the stone slightly. Prongs further secure the stone into place.

BRIEF DESCRIPTION OF THE DRAWING

FIG. 4 is a top plan view of a single link of the setting of FIGS. 1 to 3;

FIG. 5 is a view taken along lines 5—5 of FIG. 4;

FIG. 6 is a side view, partly in section, of the link of FIG. 4 bent into a position for interconnection to a second link;

FIG. 7 is a side view, partly in section, illustrating the interconnection of one link to another;

FIG. 8 is a view similar to FIG. 7 showing the second step in the interconnection of a pair of links;

FIG. 9 is a view similar to FIG. 7 illustrating the final step in the interconnection of a pair of links and, in dotted lines, also illustrating the assembly of a gem stone into one link with that link being brought into a position for interconnection to a subsequent link; and FIG. 10 is a detailed view partly in section, illustrating the stamping of an apertured raised portion in the link of FIG. 4 prior to the final appearance illustrated in FIG. 4.

DESCRIPTION OF THE PREFERRED EMBODIMENT

Figures 1, 2, 3:
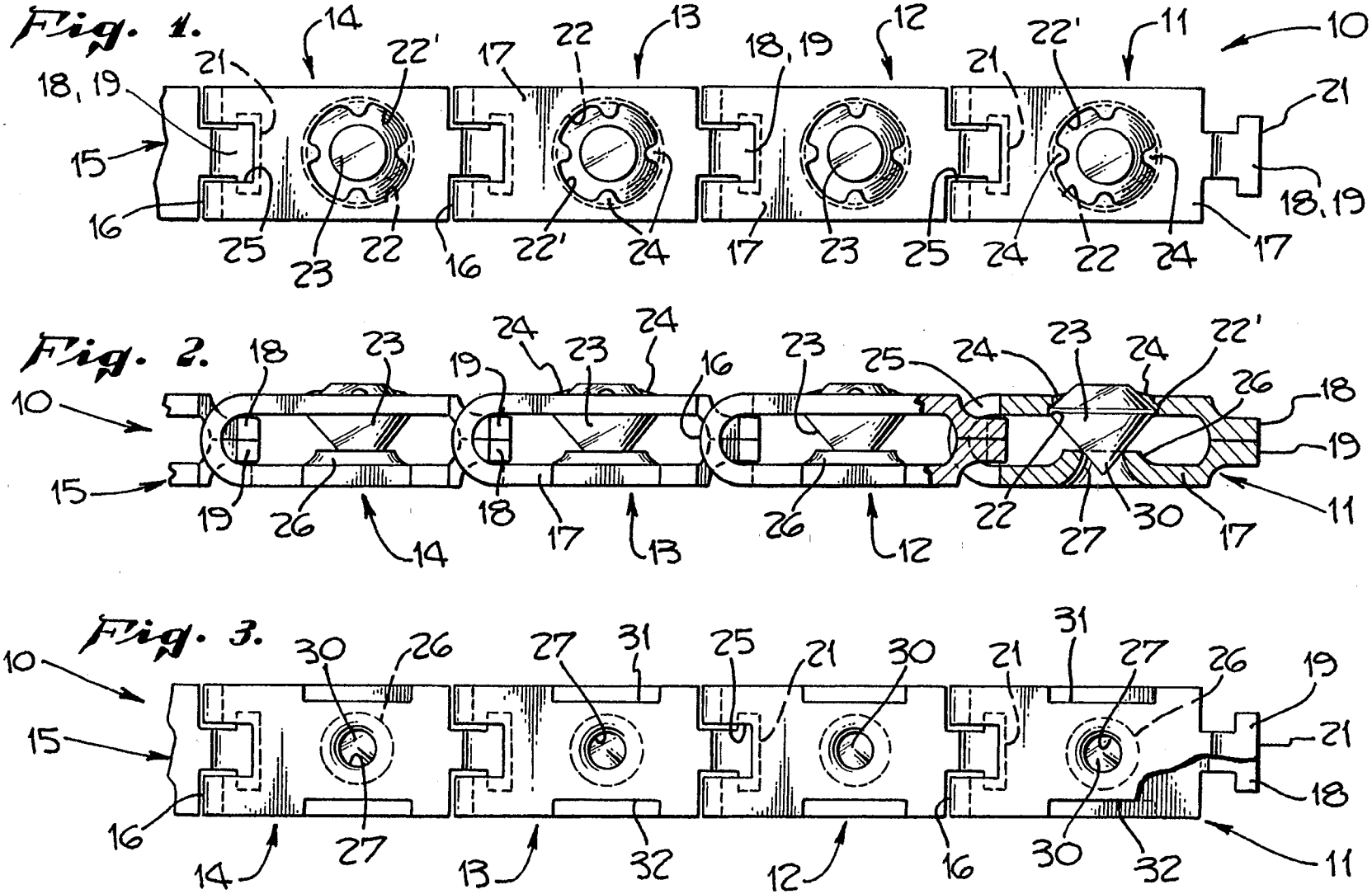
FIG. 1 is a top plan view of a plurality of interconnected links forming a setting in accordance with the invention.
FIG. 2 is an elevational view, partly in section, of the setting of FIG. 1.
FIG. 3 is a bottom plan view of the setting of FIG. 1.

Referring now to FIG. 1 of the drawing, a setting 10 for jewelry or the like is shown comprised of a plurality of interconnected links, such as links 11 to 15 (link 15 only partially shown in FIG. 1). As used throughout, setting broadly refers to any setting that contains a gem stone and may refer to one or more links as discussed hereinbelow. As individual link, such as link 11, is shown in FIG. 4. Links 11 to 15 are curved or bent downwardly, as seen in FIG. 6, during assembly and this is shown in FIG. 1 wherein the links, such as link 11, curves downwardly at area 16.

Referring again to FIG. 4, and to FIG. 5, each link, such as link 11, has a generally planar elongated rectangular main body portion 17, which may be elongated or any other particular configuration, such as square, oval, round, decorative design, rectangular, etc. of a relatively uniform thickness, with downwardly extending opposed ends 18, 19. Thus, each end 18, 19 extends outwardly, then curves downwardly, at curved area 20 (FIG. 5), then again outwardly away from main body portion 17 forming T-shaped male ends 18, 19. Ends 18, 19 lie in a horizontal plane, as seen in FIG. 5, generally parallel to the horizontal plane of main body portion 17 and are preferably integral therewith. The elongated portion 21 of each T-shaped male end is of an overall length less than the overall width of main body portion 17 as clearly seen in FIG. 4.

An opening 22 (FIG. 5) for receiving a gem stone 23 therein (see FIG. 2) is provided in each link 11 to 15. Opening 22 has a plurality of inwardly and upwardly extending spaced prongs 24 (FIGS. 4 and 5). Opening 22 is preferably the same diameter as the greatest diameter of gem stone 23 and may be embossed or rimmed about its periphery, as at embossment 22' in FIG. 4, to serve as a further retention of stone 23 should one or more of the prongs 24 break. The rim or embossment 22' slightly overlaps the stone holding it in place. As seen in FIG. 5, each prong 24 is rounded at the upper end thereof.

A rectangular slot 25 is provided through each link 11 to 15 (FIG. 4), spaced from opening 22 and along the longitudinal central axis of each link 11 to 15. A raised portion 26 (FIG. 4) having a central hole 27 is also provided in each link 11 to 15 spaced from opening 25 and along the longitudinal central axis of each link 11 to 15. Hole 27 is adapted to receive therein diameter of the lower tapered end 30 of gem stone 23 with the diameter of hole 27 being related to the diameter of stone 23 adjacent tapered end 30 to firmly grasp the same. As seen in FIG. 2, the hole 27 and raised portion 26 act as an elevated platform to support the gem stone 23 in position. The hole 27 and raised portion 26 in FIG. 5 may be formed by pushing downwardly with die 100 (FIG. 10) on the main body portion 17 punching hole 27 therein and forming a volcano-like configuration (FIG. 2) with the material of main body portion 17 forming a snug crown conforming to the base 30 of the stone 23 and holding it in place. This "lifts" the stone 23 slightly providing a support base for the stone 23 and allows light to enter into link 11 surrounding the base 30 (FIG. 2) of the stone 23 thereby showing the brilliance of stone 23. Rectangular cutout areas, as 31, 32 (FIG. 4), may be provided on each side of link 11 adjacent hole 27.

In assembly of one link to another, one of the links, such as link 11 in FIG. 6, is bent, either manually or by a precision die. The assembler then pinches the setting 11 with one thumb and an index finger on adjacent sides of setting 11 bringing ends 18, 19 together (as indicated by arrow 28 in FIG. 9). At the same time, stone 23 is inserted into opening 22 (FIG. 9—see arrow 29) and, at final assembly, prongs 24 (FIG. 2) hold stone 23 in opening 22, the base 30 of stone 23 (which may be pointed as shown) entering opening 27, the concave raised portion 26 surrounding the base 30 of stone 23 and retaining it in the installed position shown in FIG. 2.

One link is connected to another by the foregoing bending and assembly of stone 23 in link 11 and the joining together of ends 18, 19. These ends 18, 19 (FIG. 7) of one link, such as link 12, are inserted into the female opening 25 at an angle of about 90° vertically of an adjacent link, such as link 11, with the longitudinal axis of elongated parts 21 extending in the same direction as the longitudinal axis of opening 25 as seen in FIG. 7. The ends 18, 19, once through opening 25 (see FIG. 8), are then turned another 90° horizontally as seen in FIG. 9 and indicated by arrow 33. Of course, another stone 23 is assembled into link 12 as heretofore mentioned. The final assembled position of links 11 to 15 is shown in FIGS. 1 to 3. The dotted lines in FIGS. 1 and 3 indicated the location of the mating ends 18, 19 across each opening 25 and internally of each bent link 11 to 15.

It can be seen that there is disclosed a unique setting and method for forming the same. The invention can be used to set precious, semiprecious, and synthetic gem stones and the links may be formed of any suitable materials, particularly precious or semiprecious metals. Such links can be precision cut using progressive dies. A minimal amount of labor and material is necessary resulting in substantial cost savings. The opening 22 is embossed or rimmed so that the stone 23 is set that much more securely as the embossment fits snugly over the top edge of the stone, slightly overlapping onto the stone, so it acts as a security measure if a prong 24 were to break. The diameter of opening 22 is such that it is exactly the same as the overall diameter of stone 23 so there is no gap or room for play. The tip 30 of stone 23 fits securely into hole 27. The diameter of hole 27 conforms to the diameter of stone 23 adjacent tip 30. Raised portion or crown 26 firmly grasps the bottom of stone 23 with utmost precision and acts as an elevated platform as to give a slight lift to the stone so that the stone does not come into contact with the wearer's skin. The elevated platform, in addition to all of the above, also raises the stone 23 to allow more light to filter into the area below the stone which will give the stone a brighter and clearer sparkle. A crown fits snugly around the base of the stone giving the gem additional security.

The link may be bent or formed (FIG. 6) by progressive die press. This link is then ready for setting stones manually. The manual labor involved to actually set the stones involve taking one link and placing a stone 23 into its base 26. Then, one takes the same link and pinches it closed, as described above. The stone is set and the first link is ready to connect to another stone and link until the desired length of the setting is reached. Finally, a clasp which has the same male and female parts may be attached and the jewelry setting is ready to wear.

Applicant's settings are 50% or more lighter in weight than those produced by casting of the same gauge. (Casting is the foremost method used to produce multiple settings which are flexible for precious stones and, thus, there is a significant lower cost of multiple settings with precious and semiprecious stones due to the fact that less metal is needed). Channel settings have more weight than casting and therefore more gold is required which makes them more costly than casting. Generally, karat gold or sterling silver is used, both of which are expensive materials.

Utilizing applicant's method of production, one can produce 19.94 times more multiple settings than those produced by casting based on an eight hour a day. One can produce 240 07" multiple settings with three laborers' as compared to that of casting which is limited to only 38 07" settings produced per day with three full time laborers. Thus, one can produce 48,000 settings per an eight hour day. By casting, one can produce 1,000 settings per day. Applicant's settings, once produced, have all of the parts necessary to set the stone and then to connect the link to one another. In comparison, casting requires a great deal of additional labor.

Applicant's method of production requires only one part time laborer to monitor the automatic progressive die press at infrequent intervals. In comparison, casting requires three full time laborers all skilled in specific parts of production.

Applicant's settings give the stones four times more security than that of any prior method of production. First, applicant's setting sets the stones by the use of prongs. Second, an embossed rim 22' presses over the top edge of the stone firmly to hold the stone securely into place. Third, a precision-cut top opening the same diameter as that of the stone holds the stone securely in place. Fourth, an elevated platform forms a snug crown around the bottom of the stone with the opening therein being the same diameter as the base of the stone.

All prior methods of setting stones hold the stone into place by securing only the widest diameter of the stone with either prongs, wire forming, or channels. Applicant's setting requires only one pinch to set the stones. Applicant's setting requires only a single turn to connect one setting to another setting or part. Applicant's invention is the only method for multiple settings which incorporate all of its parts into one component.

One unit of applicant's setting is equipped with the setting for the stone, the prongs, and the connecting parts. All other methods for multiple settings require additional parts which require additional material and labor. This increases the cost significantly. Applicant's invention can be produced in an infinite number of designs and in an infinite number of dimensions. After the cost of the die is amortized, the labor costs for producing the setting, setting the stone, and connecting the settings to one another into a finished product is minimal. The substantial cost of producing multiple settings by casting and all other methods may in the future become obsolete for the production of multiple settings. Applicant's settings are break resistant as the connecting parts are a solid mass. All of the prior methods use either hinges or connecting rings that may or may not be soldered. All of the prior methods are attached by an appendage that can easily become detached and often times they do. Finally, applicant's method of production requires no "lapping" when the settings are produced. Casting and channel setting require, on the other hand, that the rough setting coming from the lost wax process be placed under a lapping wheel, so that the excess material can be removed. Not only does this take time, but it creates a great deal of waste.

A number of links can be produced in accordance with the teachings of the invention having a plurality of gem stone openings in each link. Various sized gem stone openings can be used to accommodate stones of varying sizes. One can merely change the assembly die components to vary the opening sizes. Clasps and other jewelry pieces can be made by the foregoing method and apparatus. All other methods require the production of a complete new setting to hold various stone sizes. A great deal of labor is saved due to applicant's method which only requires a component of the die be interchanged. This is extremely cost effective for applicant's method as compared to other methods.

It is to be understood that certain variations and modifications may occur to an artisan and the scope of the invention is limited only by the scope of the appended claims.

I claim:

1. A gem stone setting comprised of a plurality of interconnected links, each of said links comprising:

a main planar body portion terminating at each end in a male connecting end; and said body portion having an opening therethrough adjacent one male connecting end for receiving a gem stone therein, a raised portion having a centrally disposed hole adjacent the other of said male connecting ends, and a female opening through said main body portion between said first mentioned opening and said hole, said male connecting ends each having an overall length in a direction extending generally normal to the central longitudinal axis of said main body portion greater than the overall width of said female opening in a direction extending generally normal to the central longitudinal axis of said female opening with said male connecting ends of one link being brought together and disposed into the female opening of another link and interlocked therein thus interlocking one link to another with a gem stone adapted to be disposed within each of said interlocked links and retained in its respective link by abutting against both said first mentioned opening and said raised portion.

2. In the setting of claim 1 wherein a plurality of spaced prongs are provided on one side of said main body portion along the perimeter of said first mentioned opening extending inwardly toward the center of said first mentioned opening.

3. In the setting of claim 2 wherein the perimeter of said first mentioned opening is embossed or rimmed about the periphery thereof and of a diameter generally the same as the diameter of a gem stone adapted to be assembled in each of said links thereby being adapted to press over the top edge of the gem stone to hold it securely in place, said prongs extending in a direction upwardly away from said main body portion.

4. In the setting of claim 1 wherein said raised portion is concave in a direction extending from said one side of said main body portion toward said opening when said male connecting ends are brought together forming an elevated platform with a crown fitting snugly around the base of the stone, the base of the stone entering said hole, said hole being the same diameter as the base of the stone.

5. In the setting of claim 1 wherein said male connecting ends are T-shaped and said female opening is generally elongated rectangular opening having its longitudinal axis substantially coincident with the longitudinal axis of said main body portion whereby said T-shaped male ends can be inserted into said female opening.

6. In the setting of claim 1 wherein said main body portion is of relatively uniform thickness throughout.

7. In the setting of claim 1 wherein each of said male ends curve first downwardly from said main body portion, then outwardly away from said main body portion terminating in an elongated portion lying in a plane generally parallel to the plane of said main body portion but spaced therefrom.

8. In the setting of claim 7 including said elongated portions extending in a direction generally normal to the central longitudinal axis of said main body portion.

9. In the setting of claim 1 including a gem stone disposed in each of said links retained therein by abutment with both said first mentioned opening and said raised portion.

10. A link for retaining a gem stone therein and adapted to be interconnected to a like link comprising:

a main planar body portion terminating at each end in a male connecting end; and said body portion having an opening therethrough adjacent one male connecting end for receiving a gem stone therein, a raised portion having a centrally disposed hole adjacent the other of said male connecting ends, and a female opening through said main body portion between said first mentioned opening and said hole, said male connecting ends each having an overall length in a direction extending generally normal to the central longitudinal axis of said main body portion greater than the overall width of said female opening in a direction extending generally normal to the central longitudinal axis of said female opening.

11. In the link of claim 10 wherein a plurality of spaced prongs are provided on one side of said main body portion along the perimeter of said first mentioned opening extending inwardly toward the center of said first mentioned opening.

12. In the link of claim 11 wherein said prongs extend in a direction upwardly away from said main body portion.

13. In the link of claim 11 wherein said raised portion is concave in a direction extending away from said one side of said main body portion toward the other side thereof forming a platform.

14. In the link of claim 10 wherein said male connecting ends are T-shaped and said female opening is a generally rectangular opening having its longitudinal axis substantially coincident with the longitudinal axis of said main body portion.

15. In the link of claim 10 wherein said main body portion is of relatively uniform thickness throughout.

16. In the link of claim 10 wherein each of said male ends curve first downwardly from said main body portion, then outwardly away from said main body portion terminating in an elongated portion lying in a plane generally parallel to the plane of said main body portion but spaced therefrom.

17. In the link of claim 16 including said elongated portions extending in a direction generally normal to the central longitudinal axis of said main body portion.

18. In the link of claim 16 wherein a plurality of spaced prongs are provided on one side of said main body portion along the perimeter of said first mentioned opening extending inwardly toward the center of said first mentioned opening, and an embossed rim associated with said perimeter pressed over the upper peripheral edge of said gem stone holding it firmly in place.

19. A method for interconnecting a plurality of links to form a gem stone setting having at least one gem stone mounted in each link wherein each of said links comprises a main planar body portion terminating at each end in a male connecting end, said body portion having an opening therethrough adjacent one male connecting end for receiving a gem stone therein, a raised portion having a centrally disposed hole adjacent the other of said male connecting ends, and a female opening through said main body portion between said first mentioned opening and said hole, said male connecting ends each having an overall length in a direction extending generally normal to the central longitudinal axis of said main body portion greater than the overall width of said female opening in a direction extending generally normal to the central longitudinal axis of said female opening, said method comprising the steps of:

bending a first link into an L-shaped configuration;

subsequently bringing the male connecting ends of said first link together;

subsequently inserting said male connecting ends of said first link into the female opening of a second link and through said female opening; and subsequently rotating said male connecting ends within said female opening to thereby interlock said male connecting ends in said female opening.

20. In the method of claim 19 including the step of inserting a gem stone within said first link prior to interconnecting said second link thereto with said gem stone abutting against both said first mentioned opening and said raised portion, the base of said stone entering the hole in said raised portion.

21. In the method of claim 20 including the step of providing inwardly extending prongs on said first mentioned opening prior to insertion of said gem stone whereby said prongs retain said gem stone in position in said first link.

22. In the method of claim 20 including the step of forming said male connecting ends into T-shaped ends prior to insertion into said female opening and forming said female opening in the configuration of an elongated rectangle prior to insertion of said T-shaped ends therein, the overall width of said T-shaped ends being greater than the overall width of said female opening whereby said mating T-shaped ends are inserted into said female opening, then rotated 90° to lock said T-shaped ends in said female opening.

* * * * *